United States Patent [19]

Mitsuo et al.

[11] Patent Number: 4,559,242

[45] Date of Patent: Dec. 17, 1985

[54] METHOD OF PREPARING COLOR DEVELOPER SHEETS

[75] Inventors: Hirofumi Mitsuo; Shojiro Watanabe; Keiso Saeki, all of Shizuoka, Japan

[73] Assignee: Fuji Photo Film Co., Ltd., Kanagawa, Japan

[21] Appl. No.: 582,499

[22] Filed: Feb. 22, 1984

[30] Foreign Application Priority Data

Feb. 23, 1983 [JP] Japan ..... 58-28926

[51] Int. Cl.[4] ..... B41M 5/16; B41M 5/22

[52] U.S. Cl. ..... 427/150; 346/210; 346/211; 346/212; 346/216; 346/225

[58] Field of Search ..... 346/210–212, 346/216, 225, 213; 427/150, 151

[56] References Cited

FOREIGN PATENT DOCUMENTS 143322 6/1979 Japan ..... 427/150

*Primary Examiner*—Bruce H. Hess

*Attorney, Agent, or Firm*—Sughrue, Mion, Zinn, Macpeak & Seas

[57] ABSTRACT

A method of preparing a color developer sheet for pressure-sensitive recording is described. The method comprises preparing Coating Solutions A and B separately. Coating Solution A is prepared by dissolving an aromatic carboxylic acid metal salt in an organic solvent and emulsifying the resulting solution in water. Coating Solution B is prepared by mechanically dispersing an aromatic carboxylic acid metal salt in an aqueous system. Coating Solutions A and B are then mixed in such a manner that the weight ratio of the amount of the aromatic carboxylic acid metal salt in Coating Solution A to that of the aromatic carboxylic acid metal salt in Coating Solution B is from 10:90 to 90:10. The resulting mixture is then coated on a support. This color developer sheet shows high developing ability and a high color-forming rate, produces a colored member of high light resistance, and when used as an intermediate sheet, is reduced in the formation of fog.

12 Claims, No Drawings

METHOD OF PREPARING COLOR DEVELOPER SHEETS

FIELD OF THE INVENTION

The present invention relates to a method of preparing color developer sheets for pressure-sensitive recording. More particularly, it is concerned with a method of preparing color developer sheets for pressure-sensitive recording using aromatic carboxylic acid metal salts as a color developer, said color developer sheet showing superior color-developing ability and a high color-forming rate and being reduced in fog when used as an intermediate sheet because of the high light resistance of their color formers.

BACKGROUND OF THE INVENTION

Pressure-sensitive recording materials utilizing the color-forming reaction between a color former, i.e., a substance forming color on donating an electron or on accepting a proton, e.g., an acid, and a color developer, i.e., a substance accepting an electron or donating a proton, e.g., clay compounds such as acid clay, activated clay, attapulgite, zeolite, bentonite, and kaolin, aromatic carboxylic acid metal salts, and a phenol-formaldehyde resin, have heretofore been well known as described in, for example, U.S. Pat. Nos. 2,505,470, 2,505,489, 2,550,471, 2,548,366, 2,712,507, 2,730,456, 2,730,457, 3,418,250, Japanese Patent Publication (unexamined) Nos. 28411/74, 44009/75.

A color former layer of a pressure-sensitive copying paper is formed by dissolving a color former in a solvent, dispersing the solution thus prepared in a binder or encapsulating the solution, and then coating the dispersion or microcapsules as prepared above on a support such as paper, a plastic film, and a resin-coated paper.

A color developer sheet is prepared by dissolving or dispersing a binder in a medium, e.g., water, in combination with a binder, and then coating the solution or dispersion thus prepared on a support.

In general, the color former and the color developer are coated on the same surface or opposite surfaces of a support or on different supports. The color former in the microcapsule is released on application of pressure by writing or striking and comes into contact with the color developer, forming color and producing a recorded image or pattern.

As described above, various compounds are known as color developers for use in pressure-sensitive recording materials. Of these compounds, clay compounds such as activated clay and acid clay are presently in widespread use as the color developer. These clay compounds, however, have disadvantages in that the light resistance and water resistance of the final color forming member are poor and further the storage stability is poor.

It is also known that aromatic carboxylic acid salts are color developers free from the disadvantages as described above.

A color developer sheet containing such an aromatic carboxylic acid metal salt as a color developer is ordinarily prepared by mechanically dispersing a mixture of the color developer and an inorganic pigment, a binder, a dispersant and other additives in water, and then coating the thus prepared coating solution on a support.

Japanese Patent Publication (unexamined) No. 143322/79 discloses a method of preparing a color developer sheet which comprises dissolving the aromatic carboxylic acid metal salt color developer in an organic solvent, emulsifying the resulting solution in water to prepare a coating solution, and then coating the coating solution on a support. A pressure-sensitive copying sheet including a color developer sheet prepared by the method as described above has advantages in that the color developer reacts with the color former with high efficiency and exhibits excellent color-forming properties even if it is added in a small amount, and moreover, the color-forming rate is very high. However, it has been found that the pressure-sensitive copying sheet has serious disadvantages in that the light resistance of the color forming member is seriously reduced, and when the sheet is used as an intermediate sheet, printing fog is markedly formed. The intermediate sheet as described above means a material for multi-sheet copying in which a color former layer is provided on one side and a color developer layer is provided on the opposite side. The term "printing fog" as used above means the phenomenon that when the color former layer or color developer layer is printed, the microcapsules are broken by the printing pressure and the color developer released from the microcapsules permeates through the paper and comes into contact with the color developer coated on the opposite surface, forming color.

It has, therefore, been desired to overcome the problems as described above.

SUMMARY OF THE INVENTION

An object of the invention is to provide a method of preparing a color developer sheet for pressure-sensitive recording which has excellent color developing ability and a high color forming rate, and which is improved in the light resistance of a color forming member and printing fog.

It has been found that the object can be attained by preparing a mixture of Coating Solutions A and B in a specific ratio, said Coating Solution A being prepared by dissolving an aromatic carboxylic acid metal salt in an organic solvent and emulsifying the resulting solution in water, and said Coating Solution B being prepared by mechanically dispersing an aromatic carboxylic acid metal salt in an aqueous system, and then coating the mixture on a support.

The present invention relates to a method of preparing a color developer sheet for pressure-sensitive recording which comprises preparing Coating Solutions A and B separately, said Coating Solution A being prepared by dissolving an aromatic carboxylic acid metal salt in an organic solvent and emulsifying the resulting solution in water, and said Coating Solution B being prepared by mechanically dispersing an aromatic carboxylic acid metal salt in an aqueous system, mixing Coating Solutions A and B in such a manner that the ratio of the amount of the aromatic carboxylic acid metal salt in Coating Solution A to that of the aromatic carboxylic acid metal salt in Coating Solution B is from 10:90 to 90:10, and then coating the mixture as prepared above on a support.

DETAILED DESCRIPTION OF THE INVENTION

The ratio of the amount (A) of the aromatic carboxylic acid metal salt contained in Coating Solution A to the amount (B) of the aromatic carboxylic acid metal salt contained in Coating Solution B should be within the range of from 10:90 to 90:10 (weight ratio). If the ratio of (A) to (B) is less than 10:90, the developing ability and the color-forming rate of the final color developer sheet are not sufficiently high. On the other hand, if the ratio of (A) to (B) is more than 90:10, the final color developer sheet is not satisfactory in light resistance of the color-forming member and printing fog.

Useful metal salts of aromatic carboxylic acids are described in, for example, U.S. Pat. Nos. 3,864,146 and 3,983,292 and British Patent Application No. 2,017,090.

Suitable examples of such aromatic carboxylic acids include benzoic acid, ortho-, meta- or para-chlorobenzoic acid, ortho-, meta- or para-nitrobenzoic acid, ortho-, meta- or para-toluic acid, 4-methyl-3-nitrobenzoic acid, 2-chloro-4-nitrobenzoic acid, 2,3-dichlorobenzoic acid, 2,4-dichlorobenzoic acid, p-isopropylbenzoic acid, 2,5-dinitrobenzoic acid, para-tert-butylbenzoic acid, N-phenylanthranilic acid, 4-methyl-3-nitrobenzoic acid, salicylic acid, meta-hydroxy-benzoic acid, para-hydroxybenzoic acid, 3,5-dinitrosalicylic acid, 5-tert-butylsalicylic acid, 3-phenylsalicyclic acid, 3-methyl-5-tert-butylsalicylic acid, 3,5-di-tert-butylsalicylic acid, 3,5-di-tert-amylsalicylic acid, 3-cyclohexylsalicylic acid, 3-cyclohexyl-5-(α,α-dimethylbenzyl)salicylic acid, 5-cyclohexylsalicylic acid, 3-methyl-5-isoamylsalicylic acid, 5-isoamylsalicylic acid, 3,5-di-sec-butylsalicylic acid, 5-nonylsalicylic acid, 3,5-di-tert-octylsalicylic acid, 2-hydroxy-3-methylbenzoic acid, 2-hydroxy-5-tert-butylbenzoic acid, 2,4-cresotinic acid, 5,5-methylenedisalicyclic acid, ortho-, meta- or para-acetoaminobenzoic acid, 2,4-dihydroxybenzoic acid, 2,5-dihydroxybenzoic acid, anacardic acid, 1-naphthoenic acid, 3,5-di-α,α-dimethylbenzylsalicylic acid, 3,5-di-α-methylbenzylsalicylic acid, 3-(α-methylbenzyl)-5-(α,α-dimethylbenzyl)-salicylic acid, 2-naphthoenic acid, 1-hydroxy-2-naphthoenic acid, 2-hydroxy-3-naphthoenic acid, 2-hydroxy-1-naphthoenic acid, thiosalicylic acid, and 2-carboxybenzaldehyde. It is preferred to have hydroxy groups in the positions ortho or para to one or more carboxyl groups in the above-described metal salts of aromatic carboxylic acids. Of such aromatic carboxylic acids, salicylic acid derivatives are preferred and, further, those which have substituent groups containing 8 or more carbon atoms, such as alkyl, aryl or aralkyl in at least either the o- or p-position(s) to the one or more hydroxy groups and acids wherein such substituents contain 8 or more carbon atoms in total are particularly preferred. Examples of particularly preferred aromatic carboxylic acids include 3,5-di-t-butylsalicylic acid, 3,5-di-t-amylsalicylic acid, 3,5-di-α,α-dimethylbenzylsalicylic acid, 3,5-di-α-methylbenzylsalicylic acid, 3-(α-methylbenzyl)-5-(α,α-dimethylbenzyl)salicylic acid, 3,5-di-t-octylsalicylic acid and 3-cyclohexyl-5-(α,α-dimethylbenzyl)salicylic acid.

Metals whose ions are reacted with the above-described aromatic carboxylic acids to produce the corresponding salts include magnesium, aluminum, calcium, titanium, manganese, iron, cobalt, nickel, copper, zinc, cadmium, tin, antimony and barium. Of these metals, especially effective are zinc, tin and aluminum and the most effective metal is zinc among such metals.

These color developers can be used singly or in combination with each other.

The solvents as used herein are preferably organic solvents capable of dissolving therein at least 10% by weight of the aromatic carboxylic acid metal salt, such as aliphatic or aromatic esters, biphenyl derivatives, naphthalene derivatives, and diphenylalkane derivatives. Suitable examples of such organic solvents include methylamyl acetate (1,3-dimethylbutyl acetate), 2-ethylbutyl acetate, 2-ethylhexyl acetate, amyl propionate, n-butyl butyrate, isobutyl isobutyrate, 2,2,4-trimethyl-1,3-pentanediol monoisobutyrate, 2,2,4-trimethyl-1,3-pentanediol diisobutyrate, 2,4-dimethyl-2,4-pentanediol diacetate, 2,2-dimethyl-1,3-butanediol diisobutyrate, 2-methyl-2,4-pentanediol dipropionate, 2,3,3,4-tetramethyl-2,4-pentanediol monoacetate, amyl lactate, 2-methylbiphenyl, 3-methylbiphenyl, 3,3-dimethylbiphenyl, 2,4-dimethylbiphenyl, 2,6-dimethylbiphenyl, 2,4,6-trimethylbiphenyl, cyclohexylbenzene, bicyclohexylbenzene, monoisopropylbiphenyl, monoisopropylnaphthalene, diisopropylnaphthalene, 1-isopropylphenyl-2-phenylethane, 1-isopropylphenyl-1-phenylethane, 1,1-ditolylethane, 1-ethylphenyl-1-phenylethane, and 1-phenyl-1-xylylethane. Preferred examples of the organic solvent also suitable for use in the present invention are diphenylalkane derivatives as described in U.S. Pat. No. 3,836,383 or British Pat. No. 1,346,364.

Solvents with a poor ability to dissolve the solute, such as a petroleum fraction having a boiling point of from 150° to 310° C., can be used as diluents in combination with the solvents as described above.

The concentration of the aromatic carboxylic acid metal salt in the solvent is from 5 to 70% by weight and preferably from 20 to 55% by weight. The thus-prepared organic solvent solution is emulsified in water by means of a stirrer, for example, to prepare Coating Solution A. In view of the emulsion stability and developing ability, it is preferred for the viscosity of a 50% by weight organic solvent solution of the color developer to be adjusted to from 200 to 4,000 cp (centipoises) at 35° C.

The amount of the organic solvent solution to be emulsified in water is from about 5 to 120% by weight, preferably from 50 to 100% by weight, based on the weight of the water. In this case, the addition of ionic or nonionic surface active agents or water-soluble polymers produces the advantage that a stable emulsion can be obtained in a short period of time. Suitable examples of such ionic or nonionic surface active agents include an anionic surface active agent such as alkylbenzenesulfonate, e.g., triethanolamine salt of dodecylbenzenesulfonic acid, a nonionic surface active agent such as fatty acid ester of polyoxyethylene sorbitan, e.g., oleic acid ester of polyoxyethylene sorbitan, etc.

The emulsification is usually carried out by means of dissolver. The suitable particle size of the emulsion is preferably about 1 to 5 microns, more preferably 1 to 3 microns.

In preparing the coating solution, inorganic pigments such as titanium oxide, zinc oxide, silicon oxide, calcium oxide, calcium carbonate, aluminum hydroxide, kaolin, talc, barium sulfate, and activated clay can be used in combination. Preferred examples of such inorganic pigments are calcium carbonate, aluminum hydroxide, kaolin or activated clay. The use of such inorganic pigments produces various desirable effects; for example, the suitability for coating and the shielding ability are increased, and the developing ability is increased. The amount of the inorganic pigment used is preferably from 1 to 1,000 parts by weight per part of the color developer, more preferably from 2 to 50 parts by weight.

Coating Solution B is prepared by dispersing the aromatic carboxylic acid metal salt in an aqueous system mechanically, such as by means of a ball mill, an attritor, or a sand mill. In this case, the addition of the pigments as described hereinafter produces desirable effects; for example, the dispersion efficiency and developing ability are increased.

Inorganic pigments that can be used include oxides, hydroxides, carbonates, and silicates of polyvalent metals such as magnesium, aluminum, calcium, titanium, manganese, nickel, zinc, zirconium, molybdenum, tin, antimony, and lead (e.g., zinc oxide, calcium oxide, titanium oxide, zinc hydroxide, magnesium hydroxide, aluminum hydroxide, magnesium carbonate, calcium carbonate, and aluminum silicate), kaolin, talc, and activated clay, preferably calcium carbonate, aluminum hydroxide, kaolin or activated clay. The amount of the inorganic pigment added is from 0.1 to 30 parts per part of the color developer.

For the mechanical treatment as described above, it is most preferred to use a sand mill in view of the dispersion efficiency and the developing ability.

Coating Solutions A and B as prepared above are mixed in such a manner that the ratio of the amount (A) of the aromatic carboxylic acid metal salt contained in Coating Solution A to the amount (B) of the aromatic carboxylic acid metal salt contained in Coating Solution B is from 10:90 to 90:10 (weight ratio). The weight ratio of (A) to (B) is preferably from 30:70 to 70:30 and most preferably from 40:60 to 55:45.

Binders are added to the Coating Solutions A and B mixture as prepared above and coated on a support. These binders can be added before Coating Solutions A and B are mixed.

Binders which can be used are those compounds commonly used in the art, such as latexes (e.g., a styrene-butadiene copolymer latex) and synthetic or natural polymeric substances (e.g., polyvinyl alcohol, a maleic anhydride-styrene copolymer, starch, casein, gum arabic, gelatin, carboxymethyl cellulose, and methyl cellulose). Preferred examples of such binders are styrene-butadiene copolymer, polyvinyl alcohol, and starch. The amount of the binder to be used is preferably from about 3 to 20% by weight based on the weight of the total solid components, more preferably from 5 to 15% by weight.

The final amount of the aromatic carboxylic acid metal salts as organic color developer being coated on the support is from about 0.1 to 3.0 g/m$^2$ and preferably from 0.2 to 1.0 g/m$^2$.

Color formers which react with the color developer sheet of the invertion include triallylmethane-based compounds, diphenylmethane-based compounds, xanthene-based compounds, thiazine-based compounds, and spiropyran-based compounds.

Typical examples of color formers are as follows:

(1) Triarylmethane-based compounds, such as 3,3-bis(p-dimethylaminophenyl)-6-dimethylaminophthalide (i.e., Crystal Violet Lactone), 3,3-bis(p-dimethylaminophenyl)phthalide, 3-(p-dimethylaminophenyl)-3-(1,2dimethylindol-3-yl)phthalide, 3-(p-dimethylaminophenyl)- 3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, and 3-p-dimethylaminophenyl-3-(1-methylpyrrol-2-yl)-6-dimethylaminophthalide;

(2) Diphenylmethane-based compounds, such as 4,4'-bisdimethylaminobenzhydrin benzyl ether, N-halophenyl leucoauramine, and N-2,4,5-trichlorophenyl leucoauramine;

(3) Xanthene-based compounds, such as Rhodamine B-anilinolactam, Rhodamine B-p-nitroanilinolactam, Rhodamine B-p-chloroanilinolactam, 2-dimethylamino-7-methoxyfluoran, 3-diethylamino-7-methoxyfluoran, 3-diethylamino-7-chlorofluoran, 2-diethylamino-3-chloro-7-methylfluoran, 7-diethylamino-2,2-dimethylfluoran, 7-diethylamino-3-acetylmethylaminofluoran, 7-diethylamino-3'-methylaminofluoran, 3-diethylamino-6-methyl-7-anilinofluoran, 3,7-diethylaminofluoran, 3-diethylamino-7-dibenzylaminofluoran, 3-diethylamino-7-methylbenzylaminofluoran, 3-diethylamino-7-chloroethylmethylaminofluoran, and 3-diethylamino-7-diethylaminofluoran;

(4) Thiazine-based compounds, such as benzoyl leuco Methylene Blue, and p-nitrobenzoyl leuco Methylene Blue; and (5) Spiro-based compounds, such as 3-methylspiro-dinaphthopyran, 3-ethyl-spiro-dinaphthopyran, 3,3'-dichloro-spiro-dinaphthopyran, 3-benzyl-spiro-dinaphthopyran, 3-methylnaphtho-(3-methoxy-benzo)-spiropyran, and 3-propyl-spiro-dibenzopyran.

These color formers are sometimes used as a mixture comprising two or more thereof depending on the use of the final product.

The color former is dissolved in a solvent, encapsulated, and coated on a support in the usual manner.

As the solvents to dissolve therein the color formers, natural or synthetic oils can be used singly or in combination with each other. Suitable examples of such solvents include cotton seed oil, kerosene, paraffin, naphthene oil, alkylated biphenyl, alkylated terphenyl, alkylated naphthalene, diarylethane, triarylmethane and chlorinated paraffin.

Color former-containing microcapsules can be prepared by techniques such as an interfacial polymerization method as described in British Pat. Nos. 867,797, 950,443, 989,264, 1,091,076 and 2,062,570, and U.S. Pat. No. 4,409,156, an inner polymerization method, a phase separation method, an outer polymerization method, and a coacervation method as described in U.S. Pat. Nos. 2,800,457 and 2,800,458.

In preparing the coating solution containing such color former-containing microcapsules, water-soluble binders and latex binders are usually used. In addition, capsule preservatives such as cellulose powder, starch particles, and talc are added.

The color developer sheet for pressure-sensitive recording of the invention can be prepared as an intermediate sheet in which the color developer-containing coating solution is coated on one surface of a support and the color former-containing microcapsule coating solution is coated on the other surface.

The color developer sheet for pressure-sensitive recording of the invention was tested for its performance using a color former-containing microcapsule sheet as described below. Unless otherwise indicated in the following examples, all parts and percents are by weight.

Preparation of Color Former-Containing Microcapsule Sheet

Five parts of a partial sodium salt of polyvinylbenzenesulfonic acid (produced by National Starch Co., Ltd.; VERSA, TL 500; average molecular weight: 500,000) was added to 95 parts of hot water maintained at about 80° C. while stirring and dissolved therein over about 30 minutes. At the end of the time, the resulting aqueous solution was cooled. The pH of the aqueous solution was 2 to 3. Thus, the aqueous solution was adjusted to pH 4.0 by adding a 20% by weight aqueous solution of sodium hydroxide.

Diisopropylnaphthalene (100 parts) with 2.5% of Crystal Violet Lactone and 1.0% of Benzoyl Leuco Methylene Blue dissolved therein was emulsified and dispersed in 100 parts of a 5% aqueous solution of the same polyvinylbenzenesulfonic acid partial sodium salt as used above to prepare an emulsion having a mean grain diameter of 4.5μ.

A mixture of 6 parts of melamine, 11 parts of a 37% by weight aqueous solution of formaldehyde, and 30 parts of water was heated to 60° C. and stirred at that temperature. After 30 minutes, an aqueous solution of a mixture of a melamine, formaldehyde and melamine-formaldehyde initial condensate mixture was obtained. The pH of the aqueous solution was 6 to 8. This aqueous solution is hereinafter referred to as an "initial condensate solution".

The initial condensate solution and the emulsion as prepared above were mixed, adjusted to pH 6.0 with a 3.6% by weight hydrochloric acid solution while stirring, raised in temperature to 65° C., and stirred at that temperature for 360 minutes. The thus-prepared capsule dispersion was cooled to room temperature and adjusted to pH 9.0 with 20% by weight sodium hydroxide.

To the capsule dispersion were added 200 parts of a 10% by weight aqueous solution of polyvinyl alcohol and 50 parts of starch particles. The solids content of the mixture was adjusted to 20% by adding water to prepare a color former-containing microcapsule coating solution.

The coating solution as prepared above was coated on a paper sheet (50 g/m$^2$) by means of an air knife coater so that the amount of the solids coated was 5 g/m$^2$, and then dried to prepare a color former-containing microcapsule sheet.

The present invention is described in greater detail with reference to the following Examples and Comparative Examples. However, the scope of the invention is not limited to these examples.

EXAMPLE 1

Ten parts of zinc 3,5-di-α-methylbenzylsalicylate was added to 20 parts of 1-isopropylphenyl-2-phenylethane and dissolved therein by heating at 90° C. The thus-prepared solution was added to 50 parts of a 2% aqueous solution of polyvinyl alcohol (PVA-205, produced by Kuraray Co., Ltd.), and additionally 0.1 part of a 10% aqueous solution of sodium sulfosuccinate as a surface active agent was added thereto. The resulting mixture was processed in a homogenizer to prepare an emulsion having a mean grain diameter of 3μ.

Then, 80 parts of calcium carbonate, 20 parts of zinc oxide, 1 part of sodium hexametaphosphate, and 200 parts of water were mixed in a Kedy mill to prepare a suspension.

The suspension as prepared above was mixed with the emulsion as prepared above. Then, 100 parts of a 10% aqueous solution of PVA-110 (produced by Kuraray Co., Ltd.) and 10 parts (as solids) of a carboxy-modified SBR latex (SN-304, produced by Sumitomo Nogatax Co., Ltd.) were added thereto as binders. The solids content was adjusted to 20% by adding water to prepare Coating Solution A.

A mixture of 10 parts of zinc 3,5-di-α-methylbenzylsalicylate, 80 parts of calcium carbonate, 20 parts of zinc oxide, 1 part of sodium hexametaphosphate, and 200 parts of water was uniformly dispersed in a sand grinder so that the mean grain diameter was 3μ.

To the thus-prepared dispersion were added 100 parts of a 10% aqueous solution of PVA-110 (produced by Kuraray Co., Ltd.) and 10 parts (as solids) of a carboxy-modified SBR latex (SN-304, produced by Sumitomo Nogatax Co., Ltd.). The solids content of the resulting mixture was adjusted to 20% by adding water to prepare Coating Solution B.

Coating Solutions A and B as prepared above were mixed in a ratio (calculated as zinc 3,5-di-α-methylbenzylsalicylate) of A:B=50:50 (weight ratio), coated on a paper sheet (50 g/m$^2$) by means of an air knife coater so that the amount of the solids coated was 5.0 g/m$^2$, and dried to prepare a color developer sheet.

EXAMPLE 2

A color developer sheet was prepared in the same manner as in Example 1 except that the ratio of Coating Solution A to Coating Solution B was changed to A:B=65:35 (weight ratio).

EXAMPLE 3

A color developer sheet was prepared in the same manner as in Example 1 except that the ratio of Coating Solution A to Coating Solution B was changed to A:B=35:65 (weight ratio).

COMPARATIVE EXAMPLE 1

A color developer sheet was prepared in the same manner as in Example 1 except that the ratio of Coating Solution A to Coating Solution B was changed to A:B=5:95 (weight ratio).

COMPARATIVE EXAMPLE 2

A color developer sheet was prepared in the same manner as in Example 1 except that the ratio of Coating Solution A to Coating Solution B was changed to A:B=0:100 (weight ratio).

COMPARATIVE EXAMPLE 3

A color developer sheet was prepared in the same manner as in Example 1 except that the ratio of Coating Solution A to Coating Solution B was changed to A:B=95:5 (weight ratio).

COMPARATIVE EXAMPLE 4

A color developer sheet was prepared in the same manner as in Example 1 except that the ratio of Coating Solution A to Coating Solution B was changed to A:B=100:0 (weight ratio).

Preparation of Intermediate Sheets

The color former microcapsule coating solution as described above was coated on the reverse surface of each of the color developer sheets prepared in Examples 1 to 3 and Comparative Examples 1 to 4 by means of an air knife coater so that the amount of the solids coated was 5 g/m$^2$, and then dried to prepare the corresponding intermediate sheet.

Testings (1) Developing Ability and Color-Forming Rate

The color former-containing microcapsule sheet was placed on each of the color developer sheets prepared in the Examples and Comparative Examples, and a load of 600 kg/cm$^2$ was applied thereon to cause them to form color.

The intensity of the colored member at 610 mm was measured with Hitachi Color Analyzer Model 307 type 15 seconds and also 1 day after the formation of color. The color forming rate was defined as follows:

$$\text{Color-Forming Rate} = \frac{\text{Intensity after 15 seconds}}{\text{Intensity after 1 day}}$$

The developing ability was defined as follows:

$$\text{Developing Ability} = \text{Intensity after 1 day}$$

(2) Light Resistance

One day after the formation of color, each colored member as obtained in (1) above was irradiated with light for 4 hours. At the end of the time, the intensity at 610 mm was measured. The light resistance value was defined as follows:

$$\text{Light Resistance} = \frac{\text{Intensity after irradiation with light}}{\text{Intensity before irradiation with light}}$$

(3) Printing Fog

Each intermediate sheet was mounted on a letterpress printing machine Model KSB type (produced by Heidelberg Co., West Germany), and the color developer-coated surface was printed at a printing rate of 3,000 sheets per hour by a letterpress printing method. The thus-printed sheets were placed on one another and the printing fog formed on the color developer-coated surface was observed with the eye.

The rating was as follows:

A: Almost no fog observed.

B: Fog formed only slightly.

C: Fog formed.

D: Fog seriously formed.

From a practical point, A and B are desirable.

TABLE 1

| Color Developer Sheet or Intermediate Sheet | Performance | | | |
|---|---|---|---|---|
| | Developing Ability | Color-Forming Rate | Light Resistance | Printing Fog |
| Example 1 | 1.02 | 0.90 | 0.75 | A |
| Example 2 | 1.02 | 0.91 | 0.74 | B |
| Example 3 | 1.01 | 0.88 | 0.77 | A |
| Comparative Example 1 | 0.84 | 0.60 | 0.75 | A |
| Comparative Example 2 | 0.81 | 0.58 | 0.75 | A |
| Comparative Example 3 | 1.01 | 0.91 | 0.43 | C |
| Comparative Example 4 | 1.00 | 0.91 | 0.41 | D |

As can be seen from Table 1, the color developer sheets and intermediate sheets of Examples 1 to 3 were satisfactory with respect to their developing ability, color-forming rate, light resistance, and printing fog.

While the invention has been described in detail and with reference to specific embodiments thereof, it will be apparent to one skilled in the art that various changes and modifications can be made therein without departing from the spirit and scope thereof.

What is claimed is:

1. A method of preparing a color developer sheet for pressure-sensitive recording, comprising:

preparing a Coating Solution A by dissolving an aromatic carboxylic acid metal salt in an organic solvent and emulsifying the resulting solution in water;

preparing a Coating Solution B by mechanically dispersing an aromatic carboxylic acid metal salt in an aqueous system;

mixing the Coating Solution A and the Coating Solution B such that the weight ratio of the amount of the aromatic carboxylic acid metal salt in Coating Solution A to that of the aromatic carboxylic acid metal salt in Coating Solution B is in the range of from 10:90 to 90:10; and coating the resulting mixture on a support base.

2. A method as claimed in claim 1, wherein in the Coating Solution A, the concentration of the aromatic carboxylic acid metal salt in the solvent is in the range of from 5 to 70% by weight.

3. A method as claimed in claim 2, wherein in the Coating Solution A, the concentration of the aromatic carboxylic acid metal salt is in the range of from 20 to 55% by weight.

4. A method as claimed in claim 1, wherein the organic solvent in the Coating Solution A is such that a 50 wt % organic solvent solution of the aromatic carboxylic acid metal salt in the solvent at 35° C. has a viscosity in the range of 200 to 4,000 centipoises.

5. A method as claimed in claim 1, wherein the organic solvent solution to be emulsified is present in an amount of 5 to 120% by weight based on the amount of water.

6. A method as claimed in claim 5, wherein the organic solvent solution is present in an amount in the range of 50 to 100% by weight based on the amount of water.

7. A method as claimed in claim 1, wherein the Coating Solution A is further comprised of an inorganic pigment in an amount of 1 to 1,000 parts by weight per 1 part of the color developer.

8. A method as claimed in claim 7, wherein the inorganic pigment is present in an amount in the range of 2 to 50 parts by weight per 1 part of the color developer.

9. A method as claimed in claim 1, wherein the mixing weight ratio of the Coating Solution A to the Coating Solution B is in the range of 30:70 to 70:30.

10. A method as claimed in claim 9, wherein the mixing weight ratio of the Coating Solution A to the Coating Solution B is in the range of from 40:60 to 55:45.

11. A method as claimed in claim 1, wherein the aromatic carboxylic acid metal salts are present on the support base in an amount in the range of 0.1 to 3.0 g/m$^2$.

12. A method as claimed in claim 11, wherein the amount of the aromatic carboxylic acid metal salts on the support base is in the range of 0.2 to 1.0 g/m$^2$.

* * * * *